US005785490A

United States Patent [19]

Dobler et al.

[11] Patent Number: 5,785,490

[45] Date of Patent: Jul. 28, 1998

[54] FLUID PUMP

[75] Inventors: Klaus Dobler; Michael Huebel, both of Gerlingen; Willi Strohl, Beilstein, all of Germany

[73] Assignee: Robert Bosch GmbH, Stuttgart, Germany

[21] Appl. No.: 722,235

[22] PCT Filed: Jan. 11, 1996

[86] PCT No.: PCT/DE96/00028

§ 371 Date: Oct. 11, 1996

§ 102(e) Date: Oct. 11, 1996

[87] PCT Pub. No.: WO96/24770

PCT Pub. Date: Aug. 15, 1996

[30] Foreign Application Priority Data

Feb. 11, 1995 [DE] Germany ..... 195 04 564.5

[51] Int. Cl.[6] ..... F04D 5/00

[52] U.S. Cl. ..... 415/55.1; 415/55.2; 415/55.4

[58] Field of Search ..... 415/55.1, 55.2, 415/55.3, 55.4, 55.5

[56] References Cited

U.S. PATENT DOCUMENTS

| | | | |
|---|---|---|---|
| 3,356,033 | 12/1967 | Ullery | 415/55.4 |
| 3,459,130 | 8/1969 | Skinner | 415/55.4 |
| 4,412,781 | 11/1983 | Abe et al. | 415/55.4 |
| 5,558,490 | 9/1996 | Dobler et al. | 415/55.1 |

FOREIGN PATENT DOCUMENTS

| | | | |
|---|---|---|---|
| 1026174 | 3/1958 | Germany | 415/55.3 |
| 59-4 | 1/1984 | Japan | 415/55.4 |

*Primary Examiner*—John T. Kwon

*Attorney, Agent, or Firm*—Edwin E. Greigg; Ronald E. Greigg

[57] ABSTRACT

The fluid pump has a pump impeller provided with vanes and driven to revolve in a pump chamber that is defined by one wall portion each in the direction of the rotary axis of the pump impeller. In both wall portions, toward the pump impeller, there is an annular supply conduit and an outlet opening that discharges into one supply conduit. The outlet opening is defined in the rotational direction of the pump impeller by a wall which comes to an end in the form of an edge of the end face of the wall portion. The edge has an inner portion, which is inclined in the rotational direction relative to the rotary axis with respect to an imaginary radial arrangement. The inner edge portion is adjoined by an outer edge portion, which relative to an imaginary rectilinear lengthening of the inner edge portion extends farther in the rotational direction. As a result of this embodiment, an improved outflow from the supply conduit through the outlet opening has been obtained.

20 Claims, 2 Drawing Sheets

FIG. 1
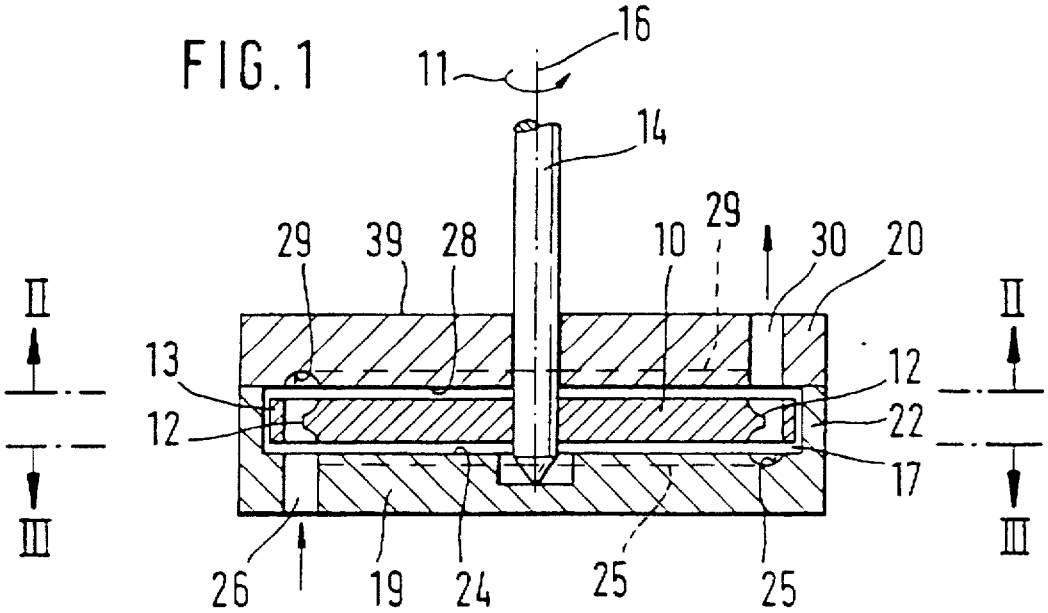
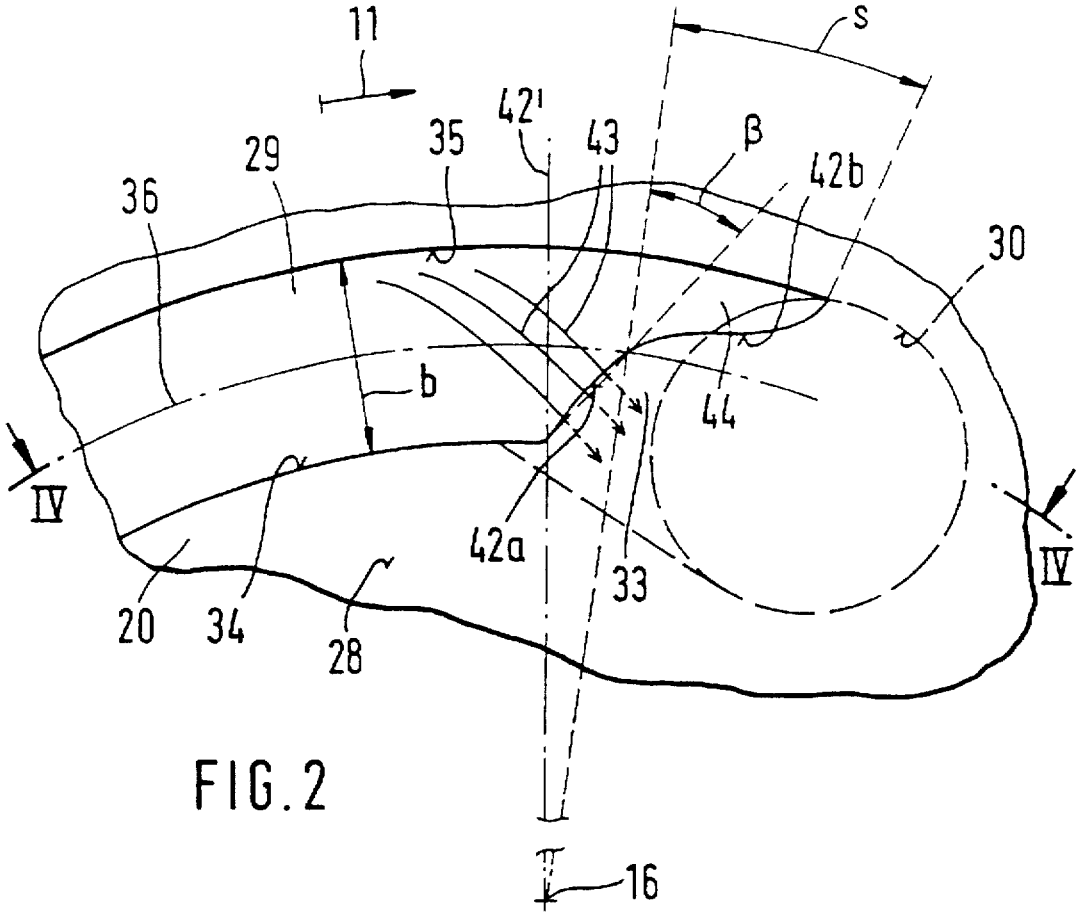
FIG. 2

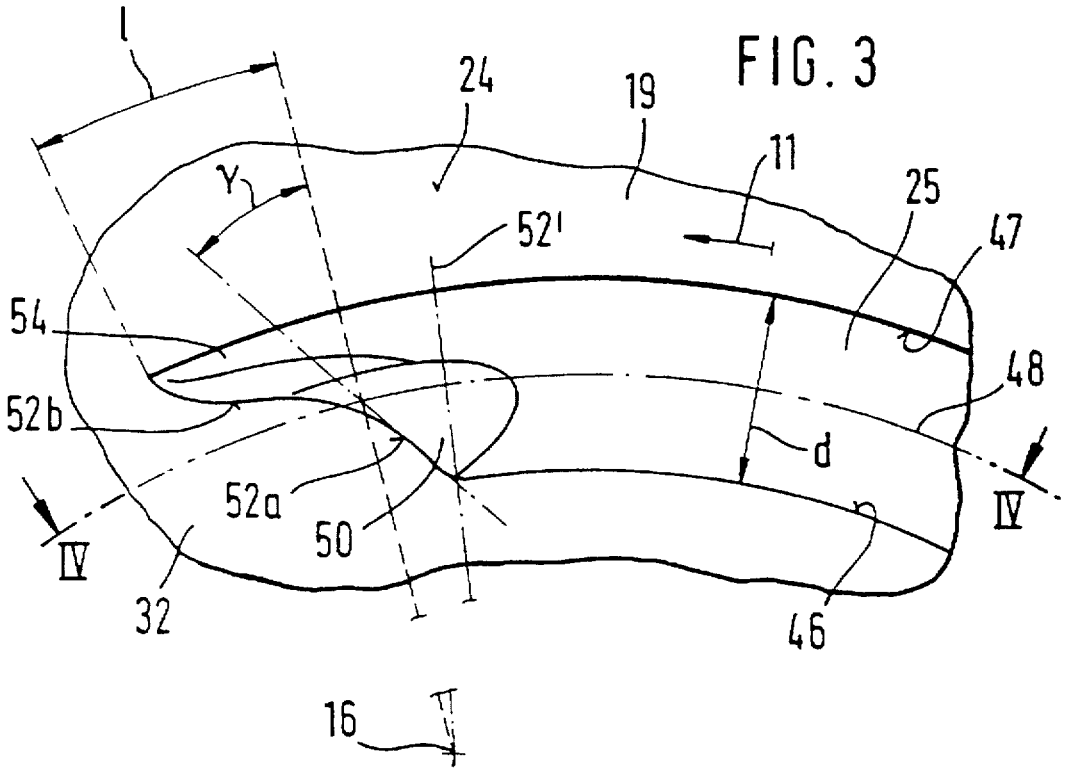
FIG. 3
FIG. 4
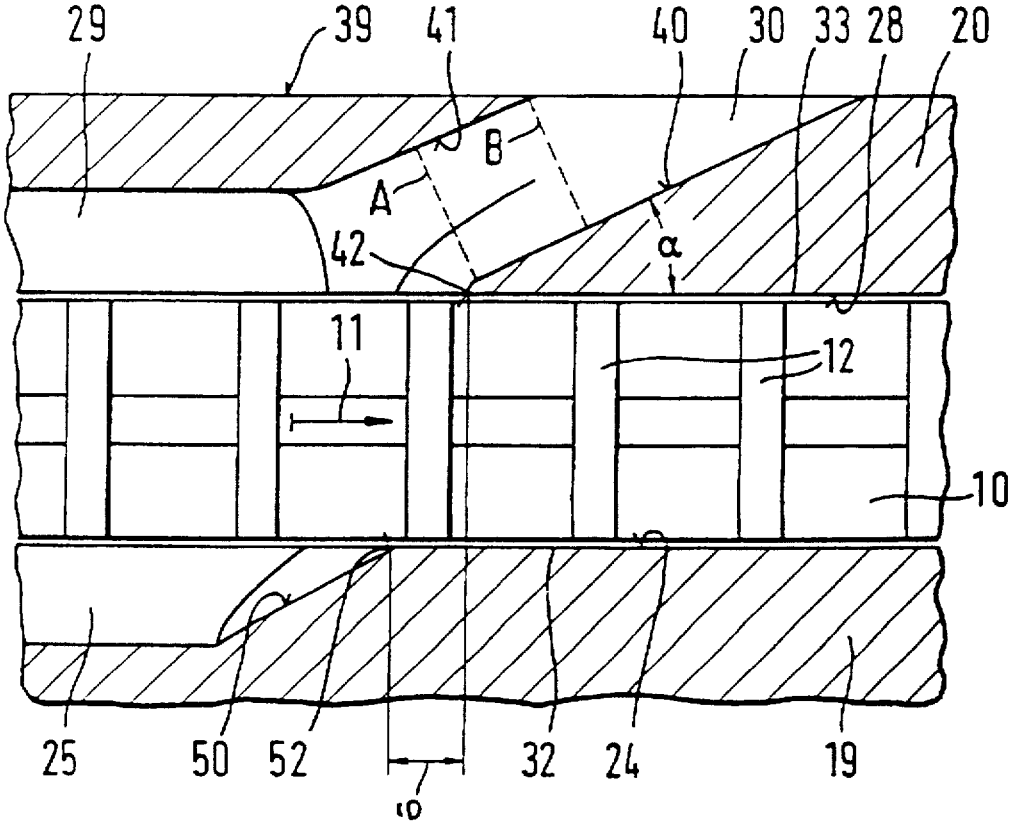

FLUID PUMP

PRIOR ART

The invention is based on a fluid pump as defined hereinafter.

One such fluid pump is known from U.S. Pat. No. 5,310,308. This fluid pump serves to feed fuel and has a pump impeller, provided with vanes, that is driven to rotate. The pump impeller is disposed in a pump chamber that is bounded by one wall portion each in the direction of the rotary axis of the pump impeller. An intake opening is formed in one wall portion and an outlet opening in the other. In each of the end faces toward the pump impeller of the two wall portions there is one supply conduit, extending circumferentially from the intake opening to the outlet opening.

The intake opening discharges at the beginning of the supply conduit in the one wall portion, while the outlet opening discharges at the end of the supply conduit of the other wall portion. The outlet opening has an opening wall, which defines the supply conduit into which the outlet opening discharges in the rotational direction of the pump impeller, and that comes to an end, on the face end toward the pump impeller of the wall portion, in the form of an edge that is rounded. This opening wall also extends approximately at right angles to the end face toward the pump impeller of the wall portion. In this embodiment of the fluid pump, severe flow turbulence and eddies are created in the region of the outlet opening, leading to losses in supply pressure and efficiency in the fluid pump. During the operation of this fluid pump, annoying noises also arise, which are likewise caused by the unfavorable flow conditions in the region of the outlet opening, which conditions cause parts of the fluid pump and especially its wall portion to vibrate.

ADVANTAGES OF THE INVENTION

The fluid pump of the invention has the advantage over the prior art that by the inclined disposition of the inner portion of the edge of the outlet opening, a favorable flow course in the region of the outlet opening is attained, and compared with the known fluid pump, the fluid pump has a higher supply pressure and higher efficiency.

A advantageous embodiments and further features of the fluid pump of the invention are disclosed hereinafter. An outflow from the supply conduit into which the inlet opening discharges is attained that has fewer losses, and this an increase in both the supply pressure and efficiency is attained. Moreover, by this further feature, a reduction in the noise created by the fluid pump during its operation is achieved. The characteristics set forth herein likewise enable an outflow with fewer losses from the supply conduit into which the inlet opening discharges, thus again enabling an increase in the supplying pressure and efficiency.

BRIEF DESCRIPTION OF THE DRAWINGS

One exemplary embodiment of the invention is shown in the drawing and described in detail in the ensuing description. FIG. 1 shows a fluid pump in a fragmentary longitudinal section. FIG. 2 shows a fragmentary cross section through the fluid pump along the line II—II of FIG. 1 in a region of the outlet opening; FIG. 3 is a fragmentary cross section through the pump along the line III—III of FIG. 1 at the end of the supply conduit; and FIG. 4 is a fragmentary cylinder jacket section through the fluid pump taken along the line IV—IV of FIG. 2 and FIG. 3.

DETAILED DESCRIPTION OF THE EXEMPLARY EMBODIMENT

A fluid pump shown in FIGS. 1–4, which in particular serves to pump fuel from a supply tank to the internal combustion engine of a motor vehicle, has a pump impeller 10, which has one ring each, beginning at its two face ends, of spaced-apart vanes 12 or blades disposed over the circumference of the pump impeller 10. The vanes 12 may be joined together via a ring 13 on their radially outer ends. The pump impeller 10 is driven via a shaft 14 to revolve about an axis 16, for instance by means of an electric motor, not shown. The pump impeller 10 is disposed in a pump chamber 17, which is bounded in the direction of the rotary axis 16 of the pump impeller 10 by one wall portion 19 and 20 on each end. In the radial direction relative to the rotary axis 16, the pump chamber 17 is defined by a cylindrical wall portion 22, which may be disposed as a separate ring between the two wall portions 19 and 20, or as shown in FIG. 1 may be integrally embodied with one of the wall portions 19 or 20. The wall portion 20 disposed toward the drive motor is embodied as an intermediate housing, and the other wall portion 29 as an aspiration cap. The shaft 14 that drives the pump impeller 10 protrudes through the intermediate housing 20 into the pump chamber 17.

An annular supply conduit 25 is embodied in the end face 24, toward the pump impeller 10, of the aspiration cap 19; it faces the ring of vanes 12 of the pump impeller 10, and an intake opening 26 that is open toward the outside of the fluid pump discharges into the beginning of this conduit. An annular supply conduit 29, into whose end an outlet opening 30 discharges, is likewise embodied, facing the ring of vanes 12 of the pump impeller 10, in the end face 28 of the intermediate housing 20 toward the pump impeller 10. The supply conduits 25 and 29 are disposed approximately coinciding and extend in the rotational direction 11 of the pump impeller 10 from the intake opening 26 to the outlet opening 30. In the region between the intake opening 26 and the outlet opening 30, the supply conduits 25 and 29 are separated from one another by a respective interruptor 32 and 33. The supply conduits 25 and 29 are approximately semicircular in cross section.

FIG. 2 shows an enlarged cross section through the fluid pump, in which the intermediate housing 20 can be seen along with the supply conduit 29 formed in it. The supply conduit 29 is defined radially inward, toward the rotary axis 16 of the pump impeller 10, by an inner edge 34 and outward by an outer edge 35. The middle region of the supply conduit 29 in the radial direction relative to the rotary axis 16 is represented by its center line 36.

The outlet opening 30, as shown in FIG. 4, extends in conduitlike fashion from the supply conduit 29 to the outer face 39 of the intermediate housing 20; the outlet opening 30 is inclined relative to the rotary axis 16 of the pump impeller 10, specifically in terms of the rotational direction 11 of the pump impeller 10 from the end face 28 of the intermediate housing 20 to the outer face 39 thereof. The wall 40 that defines the outlet opening 30 in the rotational direction 11 is inclined by an angle $\alpha$ of approximately 20° to 40° from the end face 28, toward the pump impeller 10, of the intermediate housing 20. The wall 40 may come to a point toward the end face 28, or as shown in FIG. 4 the transition from the wall 40 to the end face 28 may also be rounded. The outlet opening 30 is embodied such that its effective flow cross section downstream, between the points marked A and B in FIG. 4, remains constant or increases only slightly, or in other words by no more than about 20%. The wall 41 that defines the outlet opening 30 counter to the rotational direction 11 is inclined by approximately the same angle α as the wall 40. The outlet opening 30 is approximately circular in cross section.

The wall 40 that defines the outlet opening 30 in the rotational direction 11 comes to an end, at the end face 28 of the intermediate housing 20 toward the pump impeller 10, in the form of an edge 42 that forms the transition from the supply conduit 29 to the interruptor 33. The edge 42, viewed in the radial direction relative to the rotary axis 16, has an inner edge portion 42*a*, which extends from the inner edge 34 of the supply conduit 29 to the middle region 36 thereof and is inclined in the rotational direction 11 of the pump impeller 10 relative to an imaginary radial arrangement shown in dot-dashed lines in FIG. 2 and marked by reference numeral 42'. The inner edge portion 42*a* is inclined in the rotational direction 11 from the radial arrangement by an angle β of approximately 20° to 50°, particularly approximately 30 to 40%. The angle β is referred to the middle region 36 of the supply conduit 29 as a center point. The inner edge portion 42*a* may be embodied as slightly curved, as shown in FIG. 2, and in particular convexly curved with regard to the rotational direction 11; and the transition from the inner edge 34 of the supply conduit 29 to the edge portion 42*a* is rounded. Thus the inner edge portion 42*a* is approximately normal or in other words perpendicular to the resultant track lines of the flow of fluid pumped by the fluid pump, which are represented in FIG. 2 by arrows 43, so that the flow of the fluid in the inner portion of the supply conduit 29 is brought prematurely out of the pump, this preventing reentry into the interstices between the vanes 12 of the impeller 10. By averting reentry of the flow, the mass flow component of the circulating fluid is markedly reduced in the interruptor region 32, 33, which leads to markedly slighter pressure surges in the interruptor region 32, 33, since less kinetic energy of the circulatory flow has to be dissipated in the interruptor region. This brings about a marked reduction in noise.

In the radial direction relative to the rotary axis 16, the edge 42 has an outer edge portion 42*b* extending from the middle region 36 of the supply conduit 29 to the outer edge 35 thereof. The outer edge portion 42*b* extends farther, in the rotational direction 11 of the pump impeller 10, than the imaginary rectilinear radial lengthening of the inner edge portion 42*a*, represented by a dashed line, so that the supply conduit 29, on its outer edge 35, has an extension 44 that extends farther in the rotational direction 11 than this inner edge 35. The outer edge portion 42*b* extends farther, by a distance s, along the outer edge 35 of the supply conduit 29 in the rotational direction 11 than if there were an imaginary rectilinear lengthening of the inner edge portion 42*a*. The distance s corresponds to approximately one-half to the full width b of the supply conduit 29. The width b of the supply conduit 29 is understood to be the width upstream of the region of the outlet opening 30. The outer edge portion 42*b* extends in further fashion, preferably with a course shaped like a backward S, in terms of the rotational direction 11, and it comes to an end toward the outer edge 35 of the supply conduit 29 approximately radially to the rotary axis 16.

Preferably, the end region of the supply conduit 25 in the aspiration cap 19 is additionally also especially embodied as described below. FIG. 3 shows an enlarged cross section through the fluid pump in which the aspiration cap 19 can be seen, with the supply conduit 25 formed in it. The supply conduit 25 is bounded radially inward toward the rotary axis 16 of the pump impeller 10, by an inner edge 46 and outward by an outer edge 47. The radially middle region of the supply conduit 25 with respect to the rotary axis 16 is represented its center line 48. The supply conduit 25 is bounded on its end in the rotational direction 11 of the pump impeller 10 by a wall 50, which comes to an end, at the end face 24 toward the pump impeller 10 of the aspiration cap 19, in the form of an edge 52 that forms the transition from the supply conduit 25 to the interruption 32. The wall 50 extends from the base of the supply conduit 25 to the end face 24 of the aspiration cap 19, inclined in the rotational direction 11. The edge 52 has an inner portion 52*a*, viewed radially relative to the rotary axis 16, which extends from the inner edge 46 on the supply conduit 25 to the middle region 48 thereof and which is inclined in the rotational direction 11 of the pump impeller 10 relative to an imaginary radial arrangement shown in dot-dashed lines in FIG. 3 and identified by reference numeral 52'. The inner edge portion 52*s* is inclined in the rotational direction 11 by an angle gamma of about 20° to 50° C., especially about 30° to 40°, from the radial arrangement. The angle gamma is referred to the middle region 48 of the supply conduit 25, as its center point. The inner edge portion 52*a* may as in FIG. 3 be embodied as slightly curved, and particularly convexly curved in the rotational direction 11, and the transition from the inner edge 46 of the supply conduit 25 to the edge portion 52*a* is rounded. Thus like the inner edge portion 42*a* on the intermediate housing 20, the inner edge portion 52*a* on the aspiration cap is likewise disposed approximately normal to the resultant track lines of the pumped fluid, so that here the spillover to the outlet opening 30 in the intermediate housing 20 is initiated as early as possible.

In the radial direction relative to the rotary axis 16, the edge 52 has an outer edge portion 52*b* extending from the middle region 48 of the supply conduit 25 to the outer edge 47 thereof. The outer edge portion 52*b* extends farther, in the rotational direction 11 of the pump impeller 10, than the imaginary rectilinear radial extension of the inner edge portion 52*a*, represented by a dashed line, so that the supply conduit 25, on its outer edge 47, has an extension 54 that extends farther in the rotational direction 11 than its inner edge 46. The outer edge portion 52*b* extends farther, by a distance l, in the rotational direction 11 along the outer edge 47 of the supply conduit 25 than if there were an imaginary rectilinear lengthening of the inner edge portion 52*a*. The distance l corresponds to approximately one-half to the full width d of the supply conduit 25. The width b of the supply conduit 25 is understood to be the width upstream of its end region. The outer edge portion 52*b* extends in further fashion, preferably with a course, seen in the rotational direction 11, shaped approximately like an S, and comes to an end toward the outer edge 47 of the supply conduit 25 approximately radially to the rotary axis 16. The extension 54 of the supply conduit 25 is approximately semicircular in cross section. The wall 50 is inclined in such a way that in the middle region 48 of the supply conduit 25 in the rotational direction 11 it extends over a range that extends over from half to the full width b of the supply conduit 25.

The edge 42, which forms the transition of the supply conduit 29 to the interruptor 33 on the intermediate housing 20 and the edge 52, which forms the transition of the supply conduit 25 to the interruptor 32 on the aspiration cap 19, are preferably staggered relative to one another in the circumferential direction with regard to the rotary axis 16 of the pump impeller 10. With regard to the rotary axis 16 of the pump impeller 10, the edge 42 on the wall 20 is disposed by an angle ϕ after the edge 52 on the aspiration cap 19 in the rotational direction 11. The angle ϕ in the middle region 36 or 38 of the respective supply conduits 25 and 29 is about 5° to 15°. The beginning of the supply conduit 29 is approximately coincident, viewed in the direction of the rotary axis 16 of the pump impeller 10, with the beginning of the supply conduit 25 into which the intake opening 24 discharges.

As a result of the extensions 44 and 54 that extend from the respective middle regions 36 and 48 to the outer edges 35 and 47 of the supply conduits 29 and 25, the result attained is that the pumped fluid from the supply conduit 25 in the intake cap 19 can flow out through the outlet opening 30 with fewer losses. As a result of the above-described embodiment of the end region of the supply conduit 25 in the intake cap 19, a reduction in the noise produced by the fluid pump during its operation is also attained, since because of the favorable streamlining, the intake cap 19 in particular is not induced to vibrate, or is induced to vibrate only to a slight extent.

During the operation of the fluid pump, the fluid pump aspirates fuel through the intake opening 26 in the intake cap 19, and this fuel is fed through the supply conduits 25 and 29. At the end of the supply conduits 25 and 29, the fuel flows out at elevated pressure through the outlet opening 30; it flows through the drive motor, not shown, and reaches the engine via lines that are not shown.

The foregoing relates to preferred exemplary embodiments of the invention, it being understood that other variants and embodiments thereof are possible within the spirit and scope of the invention, the latter being defined by the appended claims.

We claim:

1. A fluid pump, for pumping fuel, comprising a housing including first and second fixed wall portions (19, 20) including inner wall end faces (24 and 28) that form a chamber (17) between an intake opening and an outlet opening, a pump impeller (10) driven to revolve in said chamber (17), said pump impeller includes vanes (12), disposed in said pump chamber (17) that is defined in a direction of a rotary axis (16) of the pump impeller by said first and second fixed wall portions (19, 20), said first and second fixed wall portions having the intake opening (26) in said first fixed wall portion (19) and the outlet opening (30) in the second fixed wall portion (20); one annular supply conduit (25, 29) extending in the wall end faces (24, 28), toward the pump impeller (10), of the first and second fixed wall portions (19, 20) and extending from the intake opening (26) to the outlet opening (30); the intake opening (26) discharges into a beginning of the annular supply conduit in said first fixed wall portion (19), and the outlet opening (30) discharges in a region of an end of the supply conduit of said second fixed wall portion (20); and the outlet opening (30) has a wall (40), which defines the supply conduit (29) into which the outlet opening discharges in a rotational direction (11) of the pump impeller (10) and which terminates, on the end face (28) toward the pump impeller (10), in an edge (42), the edge (42) viewed in the radial direction of the rotary axis (16) of the pump impeller (10) has an inner edge portion (42*a*), beginning at an inner edge (34) radially defining the supply conduit (29) relative to the rotary axis (16), and extends in an inclined fashion relative to a middle region (36) of the supply conduit (29), viewed in the radial direction relative to the rotary axis (16), with respect to an imaginary radial arrangement (42') in the rotational direction (11) of the pump impeller (10).

2. The pump in accordance with claim 1, in which the inner edge portion (42*a*) extends at an angle (β) of from about 20° to about 50°, inclined relative to the imaginary radius arrangement, with the middle region (36) of the supply conduit (29) as its center point.

3. The pump in accordance with claim 2, in which the wall (40) defining the outlet opening (30) in the rotational direction (11) of the pump impeller (10) extends inclined away from the end face (28) in the rotational direction (11), with respect to the end face (28) of the wall portion (20) toward the pump impeller (10).

4. The pump in accordance with claim 2, in which the effective flow cross section of the outlet opening (30), from the supply conduit (29) to a point of discharge at the end face (39), remote from the pump impeller (10), of the wall portion (20) increases by at most 20% or is substantially constant.

5. The pump in accordance with claim 2, in which the supply conduit (29) into the beginning of which the intake opening (26) discharges is defined on an end in the rotational direction (11) of the pump impeller (10) by a wall (50), which at the end face (24), toward the pump impeller (10), of the wall portion (19) terminates in an edge (52); that the edge (52) viewed in the radial direction with respect to the rotary axis (16) of the pump impeller (10), has an inner edge portion (52*a*), which extends in inclined fashion, from an inner edge (46) defining the supply conduit (25) radially with respect to the rotary axis (16), to a middle region (48) of a supply conduit (45) viewed in the radial direction with respect to the rotary axis (16), with regard to an imaginary radial arrangement (52') in the rotational direction (11) of the pump impeller (10).

6. The pump in accordance with claim 5, in which an inner edge portion (52*a*) extends at an angle (gamma) of about 20° to 50°, with regard to an imaginary radial arrangement, with a middle region (48) of the supply conduit (25) as its center point.

7. The pump in accordance with claim 6, in which the edge (52), beginning at the middle region (48) of the supply conduit (25) viewed in the radial direction relative to the rotary axis (16) of the pump impeller (10), to an outer edge (47) defining the supply conduit (25) radially outward, has an outer edge portion (52*b*), which extends farther in the rotational direction (11) of the pump impeller (10) than the imaginary rectilinear radial lengthening of the inner edge portion (52*a*).

8. The pump in accordance with claim 1, in which the wall (40) defining the outlet opening (30) in the rotational direction (11) of the pump impeller (10) extends inclined away from the end face (28) in the rotational direction (11), with respect to the end face (28) of the wall portion (20) toward the pump impeller (10).

9. The pump in accordance with claim 8, in which the wall (40) extends at an incline of an angle (α) of approximately 20° to 40° from the end face (28) of the wall portion (20).

10. The pump in accordance with claim 1, in which the effective flow cross section of the outlet opening (30), from the supply conduit (29) to a point of discharge at the end face (39), remote from the pump impeller (10), of the wall portion (20) increases by at most 20% or is substantially constant.

11. A fluid pump, for pumping fuel, comprising a housing including wall portions (19, 20) including inner wall end faces (24 and 28) that form a chamber (17), a pump impeller (10) driven to revolve in said chamber (17), said pump impeller includes vanes (12), disposed in said pump chamber (17) that is defined in a direction of a rotary axis (16) of the pump impeller by said wall portions (19, 20), said wall portions having an intake opening (26) in one wall portion (19) and an outlet opening (30) in the other wall portion (20); one annular supply conduit (25, 29) each extending in the wall end faces (24, 28), toward the pump impeller (10), of the wall portions (19, 20) and extending from the intake opening (26) to the outlet opening (30); the intake opening (26) discharges into a beginning of the annular supply conduit in the one wall portion (19), and the outlet opening (30) discharges in a region of an end of the supply conduit of the other wall portion (20); and the outlet opening (30) has a wall (40), which defines the supply conduit (29) into which the outlet opening discharges in a rotational direction (11) of the pump impeller (10) and which terminates, on the end face (28) toward the pump impeller (10), in an edge (42), the edge (42) viewed in the radial direction of the rotary axis (16) of the pump impeller (10) has an inner edge portion (42*a*), beginning at an inner edge (34) radially defining the supply conduit (29) relative to the rotary axis (16), and extends in an inclined fashion relative to a middle region (36) of the supply conduit (29), viewed in the radial direction relative to the rotary axis (16), with respect to an imaginary radial arrangement (42') in the rotational direction (11) of the pump impeller (10), and the edge (42), beginning at the middle region (36) of the supply conduit (29) viewed in the radial direction relative to the rotary axis (16) of the pump impeller (10), to an outer edge (35) defining the supply conduit (29) radially outward, has an outer edge portion (42*b*), which extends farther in the rotational direction (11) of the pump impeller (10) than the imaginary rectilinear radial lengthening of the inner edge portion (42*a*).

12. The pump in accordance with claim 11, in which the outer edge portion (42*b*), relative to the imaginary rectilinear radial lengthening of the inner edge portion (42*a*) on the outer edge (35) of the supply conduit (29) extends farther by approximately one half to the full width b of the supply conduit (29) in the rotational direction (11) of the pump impeller (10).

13. The pump in accordance with claim 12, in which the wall (40) defining the outlet opening (30) in the rotational direction (11) of the pump impeller (10) extends inclined away from the end face (28) in the rotational direction (11), with respect to the end face (28) of the wall portion (20) toward the pump impeller (10).

14. The pump in accordance with claim 11, in which the wall (40) defining the outlet opening (30) in the rotational direction (11) of the pump impeller (10) extends inclined away from the end face (28) in the rotational direction (11), with respect to the end face (28) of the wall portion (20) toward the pump impeller (10).

15. A fluid pump, for pumping fuel, comprising a housing including wall portions (19, 20) including inner wall end faces (24 and 28) that form a chamber (17), a pump impeller (10) driven to revolve in said chamber (17), said pump impeller includes vanes (12), disposed in said pump chamber (17) that is defined in a direction of a rotary axis (16) of the pump impeller by said wall portions (19, 20), said wall portions having an intake opening (26) in one wall portion (19) and an outlet opening (30) in the other wall portion (20); one annular supply conduit (25, 29) each extending in the wall end faces (24, 28), toward the pump impeller (10), of the wall portions (19, 20) and extending from the intake opening (26) to the outlet opening (30); the intake opening (26) discharges into a beginning of the annular supply conduit in the one wall portion (19), and the outlet opening (30) discharges in a region of an end of the supply conduit of the other wall portion (20); and the outlet opening (30) has a wall (40), which defines the supply conduit (29) into which the outlet opening discharges in the rotational direction (11) of the pump impeller (10) and which terminates, on the end face (28) toward the pump impeller (10), in an edge (42), the edge (42) viewed in the radial direction of the rotary axis (16) of the pump impeller (10) has an inner edge portion (42*a*), beginning at an inner edge (34) radially defining the supply conduit (29) relative to the rotary axis (16), and extends in inclined fashion relative to a middle region (36) of the supply conduit (29), viewed in the radial direction relative to the rotary axis (16), with respect to an imaginary radial arrangement (42') in the rotational direction (11) of the pump impeller (10), said inner edge portion (42*a*) extends at an angle (β) of from about 20° to about 50°, inclined relative to the imaginary radius arrangement, with the middle region (36) of the supply conduit (29) as its center point and the edge (42), beginning at the middle region (36) of the supply conduit (29) viewed in the radial direction relative to the rotary axis (16) of the pump impeller (10), to an outer edge (35) defining the supply conduit (29) radially outward, has an outer edge portion (42*b*), which extends farther in the rotational direction (11) of the pump impeller (10) than the imaginary rectilinear radial lengthening of the inner edge portion (42*a*).

16. The pump in accordance with claim 15, in which the outer edge portion (42*b*), relative to the imaginary rectilinear radial lengthening of the inner edge portion (42*a*) on the outer edge (35) of the supply conduit (29) extends farther by approximately one half to the full width b of the supply conduit (29) in the rotational direction (11) of the pump impeller (10).

17. A fluid pump, for pumping fuel, comprising a housing including wall portions (19, 20) including inner wall end faces (24 and 28) that form a chamber (17), a pump impeller (10) driven to revolve in said chamber (17), said pump impeller includes vanes (12), disposed in said pump chamber (17) that is defined in a direction of a rotary axis (16) of the pump impeller by said wall portions (19, 20), each of said wall portions having an intake opening (26) in one wall portion (19) and an outlet opening (30) in the other wall portion (20); one annular supply conduit (29) each extending in the wall end faces (24, 28), toward the pump impeller (10), of the wall portions (19, 20) and extending from the intake opening (26) to the outlet opening (30); the intake opening (26) discharges into a beginning of the supply conduit in the one wall portion (19), and the outlet opening (30) discharges in a region of an end of the supply conduit of the other wall portion (20); and the outlet opening (30) has a wall (40), which defines the supply conduit (29) into which the outlet opening discharges in the rotational direction (11) of the pump impeller (10) and which terminates, on the end face (28) toward the pump impeller (10), in an edge (42), the edge (42) viewed in the radial direction of the rotary axis (16) of the pump impeller (10), has an inner edge portion (42*a*), beginning at an inner edge (34) radially defining the supply conduit (29) relative to the rotary axis (16), and extends in inclined fashion relative to a middle region (36) of the supply conduit (29), viewed in the radial direction relative to the rotary axis (16), with respect to an imaginary radial arrangement (42') in the rotational direction (11) of the pump impeller (10), the supply conduit (29) into the beginning of which the intake opening (26) discharges is defined on an end in the rotational direction (11) of the pump impeller (10) by a wall (50), which at the end face (24), toward the pump impeller (10), of the wall portion (19) terminates in an edge (52); that the edge (52) viewed in the radial direction with respect to the rotary axis (16) of the pump impeller (10), has an inner edge portion (52*a*), which extends in inclined fashion, from an inner edge (46) defining the supply conduit (25) radially with respect to the rotary axis (16), to a middle region (48) of a supply conduit (45) viewed in the radial direction with respect to the rotary axis (16), with regard to an imaginary radial arrangement (52') in the rotational direction (11) of the pump impeller (10).

18. The pump in accordance with claim 17, in which the edge (52), beginning at the middle region (48) of the supply conduit (25) viewed in the radial direction relative to the rotary axis (16) of the pump impeller (10), to an outer edge (47) defining the supply conduit (25) radially outward, has an outer edge portion (**52*b*), which extends farther in the rotational direction (11) of the pump impeller (10) than the imaginary rectilinear radial lengthening of the inner edge portion (52*a***).

19. The pump in accordance with claim 18, in which the outer edge portion (**52*b*), relative to the imaginary rectilinear radial lengthening of the inner edge portion (52*a*) on the outer edge (47) of the supply conduit (25) extends farther by approximately half to the full width d of the supply conduit (25) in the rotational direction (11) of the pump impeller (10**).

20. The pump in accordance with claim 17, in which the middle region (36, 48), viewed in the radial direction with respect to the rotary axis (16), of the supply conduits (29, 35), the edge (42) of the supply conduit (29) into which the outlet opening (30) discharges is disposed at an angle ($\phi$), in the rotational direction (11) of the pump impeller (10), of about 5° to 15° after the edge (52) of the supply conduit (25) into which the intake opening (26) discharges.

* * * * *